US007656139B2

(12) United States Patent
van Ettinger

(10) Patent No.: US 7,656,139 B2
(45) Date of Patent: Feb. 2, 2010

(54) CREATING ADDITIONAL PHASE MARGIN IN THE OPEN LOOP GAIN OF A NEGATIVE FEEDBACK AMPLIFIER SYSTEM USING A BOOST ZERO COMPENSATING RESISTOR

(75) Inventor: Roel van Ettinger, Bathgate (GB)

(73) Assignee: Micrel, Incorporated, San Jose, CA (US)

( * ) Notice: Subject to any disclaimer, the term of this patent is extended or adjusted under 35 U.S.C. 154(b) by 458 days.

(21) Appl. No.: 11/764,758

(22) Filed: Jun. 18, 2007

(65) Prior Publication Data

US 2007/0241731 A1 Oct. 18, 2007

Related U.S. Application Data

(63) Continuation-in-part of application No. 11/144,899, filed on Jun. 3, 2005, now abandoned.

(51) Int. Cl.
*G05F 1/40* (2006.01)

(52) U.S. Cl. ..... 323/280; 323/274; 323/285

(58) Field of Classification Search ..... 323/273, 323/274, 275, 276, 277, 280
See application file for complete search history.

(56) References Cited

U.S. PATENT DOCUMENTS 4,779,037 A * 10/1988 LoCascio ..... 323/275
5,686,821 A 11/1997 Brokaw
6,373,233 B2 4/2002 Bakker et al.
6,603,292 B1 8/2003 Schouten et al.
6,765,374 B1 7/2004 Yang et al.
6,861,827 B1 3/2005 Yang et al.
6,861,832 B2 * 3/2005 Perez ..... 323/316
2001/0024140 A1 9/2001 Taylor
2005/0057234 A1 3/2005 Yang et al.

FOREIGN PATENT DOCUMENTS

JP 64-065610 3/1989
JP 2002-032133 1/2002

* cited by examiner

*Primary Examiner*—Jessica Han
(74) *Attorney, Agent, or Firm*—Bever, Hoffman & Harms, LLP; Patrick T. Bever

(57) ABSTRACT

A low-dropout voltage (LDO) regulator that creates a zero in the open loop gain using a relatively small-sized current control element to divert part of the supplied load current through a "zero" resistor before adding it to the output load. The main part of the output load is passed through a relatively large second current control element. A control signal generated by an error amplifier (e.g., an op-amp) is used to control the small current control element, but is passed through a boost zero compensating resistor before being applied to the large current control element. The voltage signal developed across the "zero" resistor mimics the magnitude and phase of a zero in the loop. This voltage signal is added to the loop gain by, for instance, using a bypass capacitor, and the resulting feedback signal is supplied to the error amplifier.

23 Claims, 3 Drawing Sheets

CREATING ADDITIONAL PHASE MARGIN IN THE OPEN LOOP GAIN OF A NEGATIVE FEEDBACK AMPLIFIER SYSTEM USING A BOOST ZERO COMPENSATING RESISTOR

RELATED APPLICATIONS

This application is a continuation-in-part of U.S. patent application for "CREATING ADDITIONAL PHASE MARGIN IN THE OPEN LOOP GAIN OF A NEGATIVE FEEDBACK AMPLIFIER SYSTEM", U.S. application Ser. No. 11/144,899, filed Jun. 3, 2005.

FIELD OF THE INVENTION

The present invention relates to the field of electronics, and in particular to negative feedback amplifier systems, such as low-dropout voltage regulators.

BACKGROUND OF THE INVENTION

Low dropout voltage (LDO) regulators are utilized to generate stable direct current (dc) voltages, for example, in portable, battery-operated devices such as cellular phones, cordless phones, pagers, personal digital assistants, portable personal computers, camcorders, and digital cameras. The demand for low dropout voltage (LDO) regulators has increased in direct proportion to the increased demand for such portable devices.

LDO regulators are characterized by low dropout voltages (i.e., a minimal difference between an unregulated input voltage, such as a voltage received from a battery or transformer, and the regulated (stable) output voltage). An LDO regulator fails to maintain its regulated voltage level (i.e., drops out of regulation) when the unregulated input voltage falls below the regulated output voltage plus the dropout voltage. Thus, by minimizing the dropout voltage, an LDO regulator allows a portable device to operate longer from a single battery charge. That is, the low dropout voltage of the LDO regulator effectively extends the life of the battery by providing a regulated voltage even if the battery is discharged to a value that is within (typically) 100-500 millivolts of the regulated voltage.

FIG. 4 shows a conventional LDO regulator 10 that is connected to a load 50. LDO 10 includes an operational-amplifier (op-amp) 11, a PMOS transistor M, feedback resistors R11 and R12, and a reference voltage supply REF. Load 50 is represented by a resistive load $R_L$ and a capacitive load $C_L$. In operation, a voltage supply (not shown) applies an input voltage $V_{IN}$ to one terminal of PMOS transistor M, and a portion of the output signal $V_{OUT}$ supplied to load 50 through PMOS transistor M is fed back by way of the feedback resistor R11 and R12 to the non-inverting input terminal of op-amp 11, which receives a stable reference signal from reference voltage supply REF on its inverting input terminal. In response to the feedback signal and the reference signal, op-amp 11 generates an output signal that controls PMOS transistor M to regulate the output signal $V_{OUT}$.

A very serious problem associated with conventional LDO regulator 10 is that it is not stable for all capacitive loads $C_L$. Known solutions can stabilize this circuit for values of $C_L$ larger than approximately 1 uF. Another restriction associated with this circuit is that capacitive load $C_L$ must have a low and very well-defined equivalent series resistance.

A conventional voltage control loop of an LDO regulator has two dominant poles. The first pole is created at the output by the load equivalent resistor and the load capacitor. The second pole is located in the control error amplifier (e.g., op-amp 11). Due to the large loop gain of the system, the closed loop response will become quite under-damped. A way to improve and stabilize the control loop is by adding a zero in the loop gain. One traditional effective method to create such a zero is to insert a resistor in series with the load capacitor. This approach has the drawback that higher frequency disturbances (for instance due to load variations or ripple on the power line) are not effectively reduced. Also, the parasitic series impedance of the load capacitor is usually not very well controlled, unless expensive capacitors are used. Sometimes the zero is created in the control error amplifier, but this usually requires large resistor values, which is counterproductive on silicon real estate.

What is needed is an improved negative feedback amplifier system, such as a low-dropout voltage regulator, that is stable over a large load range, does not degrade the ripple rejection at higher frequencies, and minimizes stability dependence on the parasitic resistor of the output capacitor.

SUMMARY OF THE INVENTION

The present invention is directed to an improved negative feedback amplifier system (e.g., a control circuit) that utilizes a new method of creating a zero in the open loop gain in which part of the supplied output current is diverted through a first "zero" resistor before adding it to the output voltage, and also using a second "boost zero" compensating resistor between the amplifier and the first current control element. The voltage signal developed at the first "zero" resistor in response to the partial output current mimics the magnitude and phase of a zero in the open loop transfer function, and can be fed back to any suitable node in the control loop to increase the phase margin, thus improving the stability and step response of the amplifier system. For example, this voltage signal can be added to the loop gain using a bypass capacitor that is coupled to an input terminal of the error amplifier. In this way, the voltage signal improves the phase margin over conventional feedback loops that exhibit marginal stability due to unavoidable parasitic elements which add non-dominant poles or right hand plane zeros. In addition, the second "boost zero" compensating resistor serves to prevent a fall off in gain at high frequencies. The boost zero thus improves overall system stability, especially for amplifiers that maintain significant gain at high frequency.

In accordance with a specific embodiment of the present invention, a portable device includes a battery (or other power source), a load circuit, and an LDO regulator connected between the battery and the load circuit. The LDO regulator includes a first current control element, an output stabilization circuit, and an error amplifier. The first current control element passes a portion of the unregulated battery voltage to the load circuit in response to a control signal generated by the error amplifier and transmitted through the boost zero compensating resistor. The output stabilization circuit includes a second current control element and the first "zero" resistor that are connected in series between the battery and the load circuit (i.e., parallel with the first current control element). The second current control element is also controlled by the control signal generated by the error amplifier, but is smaller than the first current control element. Thus, the output signal applied to the load circuit includes both the larger portion passed by the first switching circuit and a smaller component passed by the first "zero" resistor. A zero signal generated at a node located between the second current control element and the first "zero" resistor is added to the feedback signal, e.g., by way of a bypass capacitor, and the resulting feedback signal is compared by the error amplifier with a fixed reference voltage to generate the control signal. Before addition of the two feedback signals, the output voltage can be divided down in a traditional manner to set the output voltage level. As an alternative to adding the zero signal to the divided down feedback signal, it can be inserted at another suitable point inside the error amplifier to realize the desired effect of the zero in the loop gain.

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE DRAWINGS

As used herein, the term "coupled" refers to an electrical path between two elements that may include zero or more active or passive elements, and the term "connected" refers to a direct connection between two elements by way of a relatively conductive (e.g., metal) wire or trace.

Figure 1:
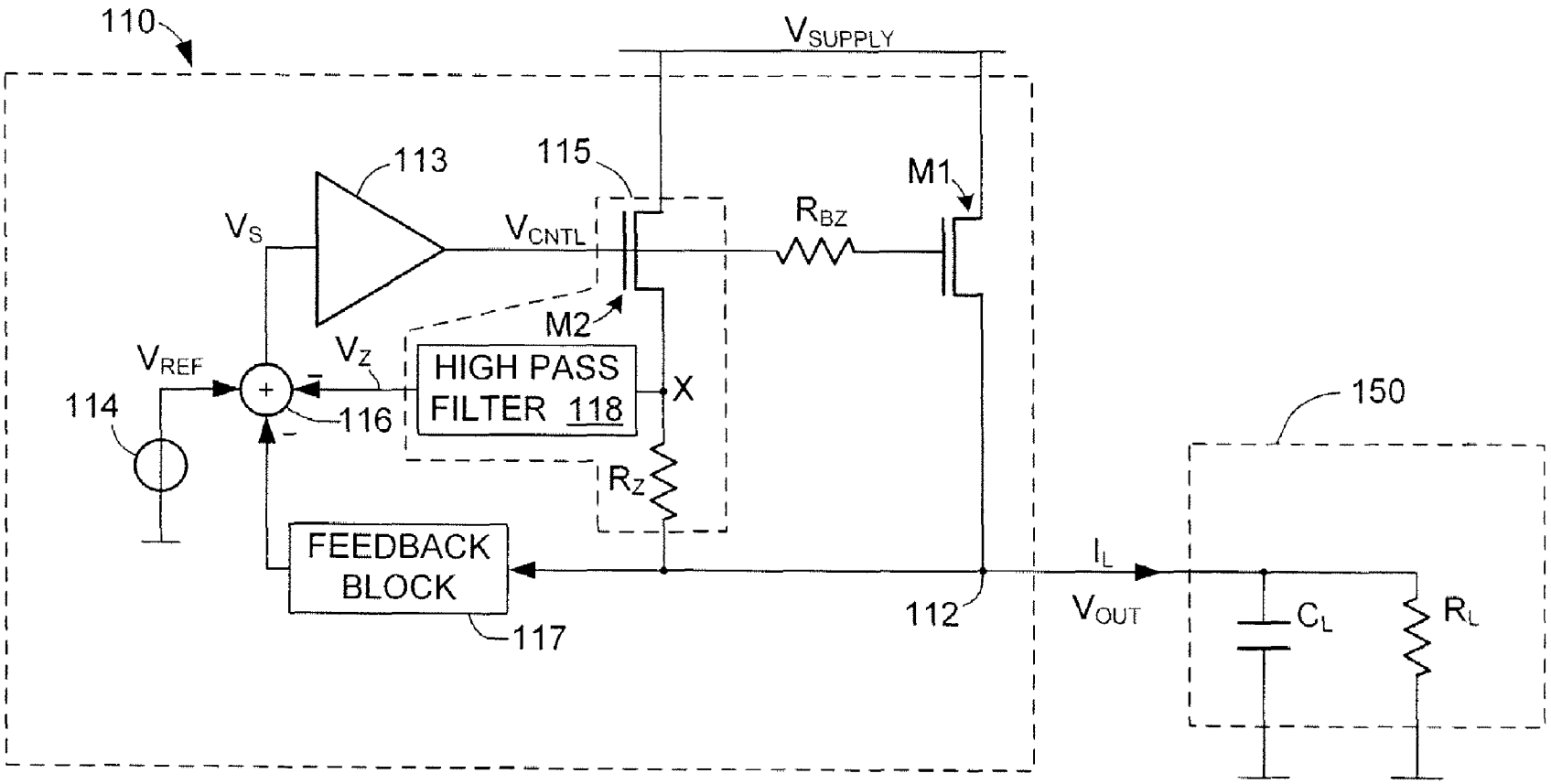
FIG. 1 is a simplified schematic diagram showing a negative feedback amplifier system according to a generalized embodiment of the present invention.

FIG. 1 shows a negative feedback amplifier system 110 according to a generalized embodiment of the present invention. Amplifier system 110 is connected between a voltage supply $V_{SUPPLY}$ (not shown) and a capacitive load circuit 150, which for simplicity is represented by a load resistor $R_L$ and a load capacitor $C_L$. In addition, amplifier system 110 receives a reference signal $V_{REF}$ from a reference voltage source 114, which in one embodiment includes a circuit integrally formed with amplifier system 110, and in another embodiment represents an external signal source. The operation of such negative feedback amplifier systems is well known to those skilled in the art.

Amplifier system 110 includes a loop amplifier 113, an output device (first current control element) M1, an output stabilization circuit 115, a summing circuit 116, and a feedback block 117. Characteristic of all negative feedback control circuits, loop amplifier 113 is controlled by a feedback signal $V_S$, which at least in part is generated by output voltage $V_{OUT}$, and generates a control signal $V_{CNTL}$ in response to feedback signal $V_S$ that is used in the manner described below to control output device M1 and output stabilization circuit 115 to maintain output voltage $V_{OUT}$ at a desired level. Output device M1 has a first terminal connected to supply voltage $V_{SUPPLY}$, a control terminal, and a second terminal connected to an output terminal 112. Output device M1 includes any suitable active device (e.g., a P-type MOSFET, an N-type MOSFET, a PNP bipolar transistor, or an NPN bipolar transistor), and is sized to provide the majority of output load current $I_L$ Output stabilization circuit 115 includes a second output device (second current control element) M2 that is connected in series with a "zero generating" (first) resistor $R_Z$ between supply voltage $V_{SUPPLY}$ and output terminal 112. Output device M2 is equivalent to output device M1 (i.e., same type (e.g., NMOS or PMOS) to assure matching and to define the current ratio current properly), but is sized to supply a small, but fixed, part of $I_L$. By passing the current from output device M2 through resistor $R_Z$ before applying it to output terminal 112, a signal voltage is created at a node X (between output device M2 and resistor $R_Z$) which mimics the phase and magnitude as if a zero was inserted in the loop gain. By adding this signal voltage to any convenient point in the loop, the phase margin of the loop can be increased, resulting in better stability, frequency and step response. An example of such a convenient point is depicted in FIG. 1 as being an input to summing circuit 116. In order not to upset the DC value at the point of insertion (e.g., the input terminal of summing circuit 116), a high pass filter 118 can be implemented, for instance, in the form of a bypass capacitor. Feedback block 117 comprises, for example, a resistive voltage divider that serves to apply a predetermined portion of $V_{OUT}$ to summing circuit 116, which is combined with the signal from node X and the reference voltage from reference voltage source 114.

In accordance with an aspect of the present invention, a boost zero compensating resistor $R_{BZ}$ is connected between the output terminal of loop amplifier 113 and the control gate of main output device M1 such that a predetermined portion of control signal $V_{CNTL}$ is supplied to output device M1. In one embodiment boost zero compensating resistor $R_{BZ}$ is a simple resistor, but in alternative embodiments boost zero compensating resistor $R_{BZ}$ is implemented by any device that provides a suitable resistance at high frequency (such as an inductor or an active device mimicking a resistor).

Figure 2:
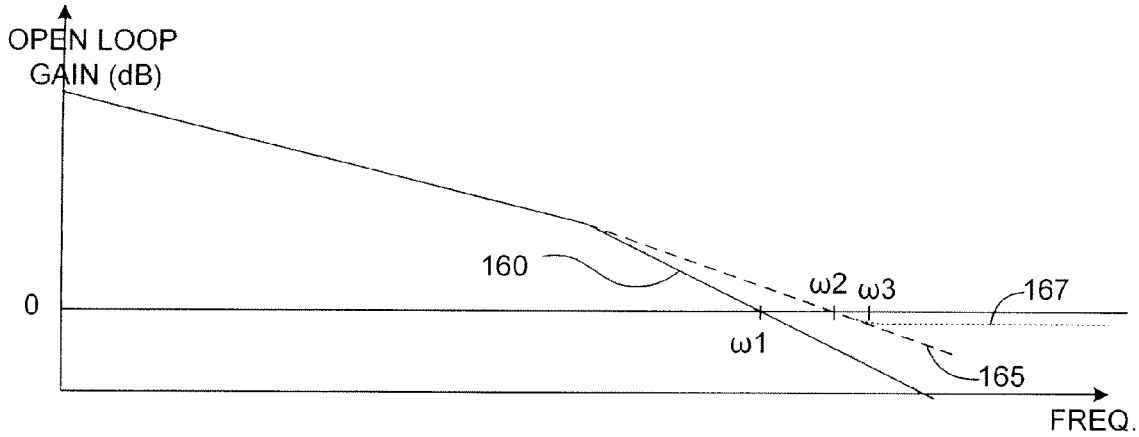
FIG. 2 is a Bode diagram depicting operating characteristics associated with the negative feedback amplifier system of FIG. 1.

FIG. 2 shows the transfer function from Vref to Vout (plot 160) and from Vref to Vz (plot 165 without boost zero and plot 167 with boost zero). As indicated in FIG. 2 the transfer function from Vref to Vout is the same with or without the boost resistor since this transfer function is dominated by the larger transconductance of M1. However, with the present invention the transfer function from Vref to Vz (the compensation point) includes, due to the boost resistor $R_{BZ}$, an additional zero at ω3 which helps stabilize the loop at higher frequencies. FIG. 2 plot 167 clearly shows the effect of the boost zero over the non-boosted version plot 165. The value of frequency ω3 can be selectively set by adjusting the resistance value of boost zero compensating resistor $R_{BZ}$. This additional zero improves overall stability especially for amplifiers that maintain significant gain at high frequencies.

Figure 3:
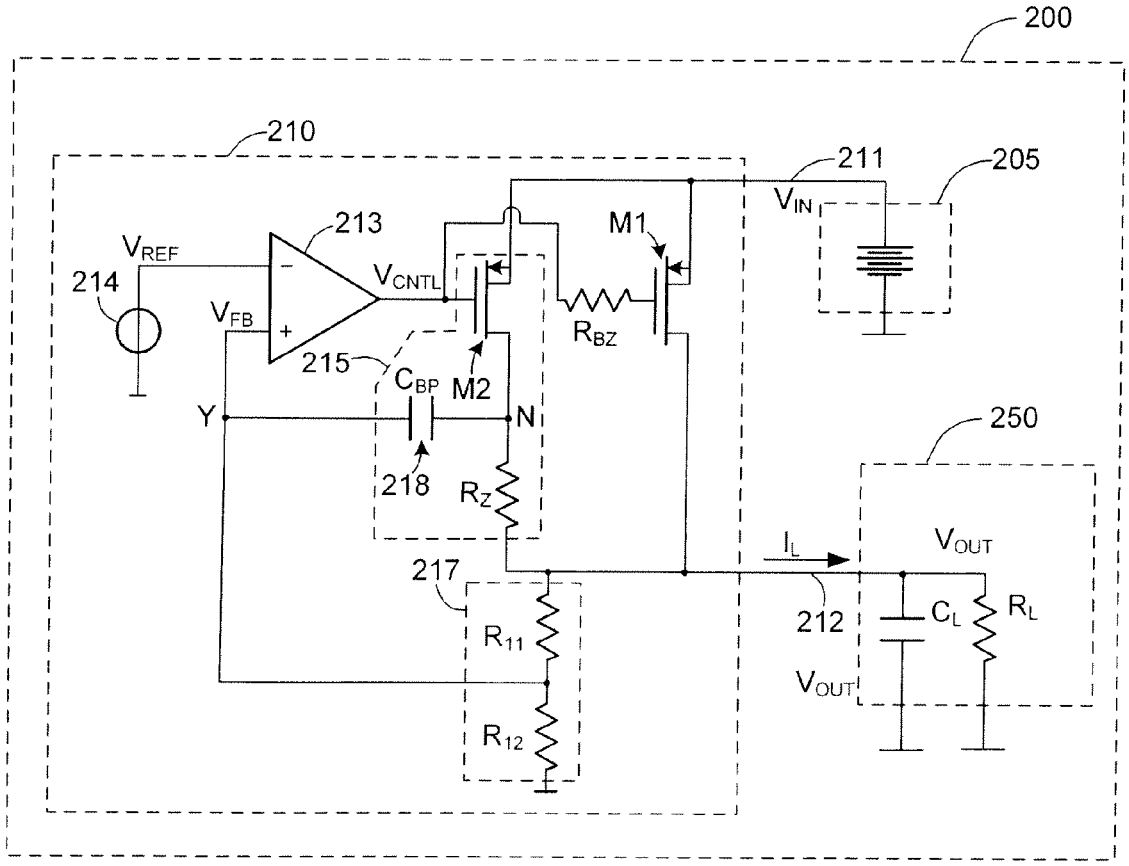
FIG. 3 is a simplified schematic diagram showing a portable device including an LDO regulator according to a specific embodiment of the present invention.
Figure 4:
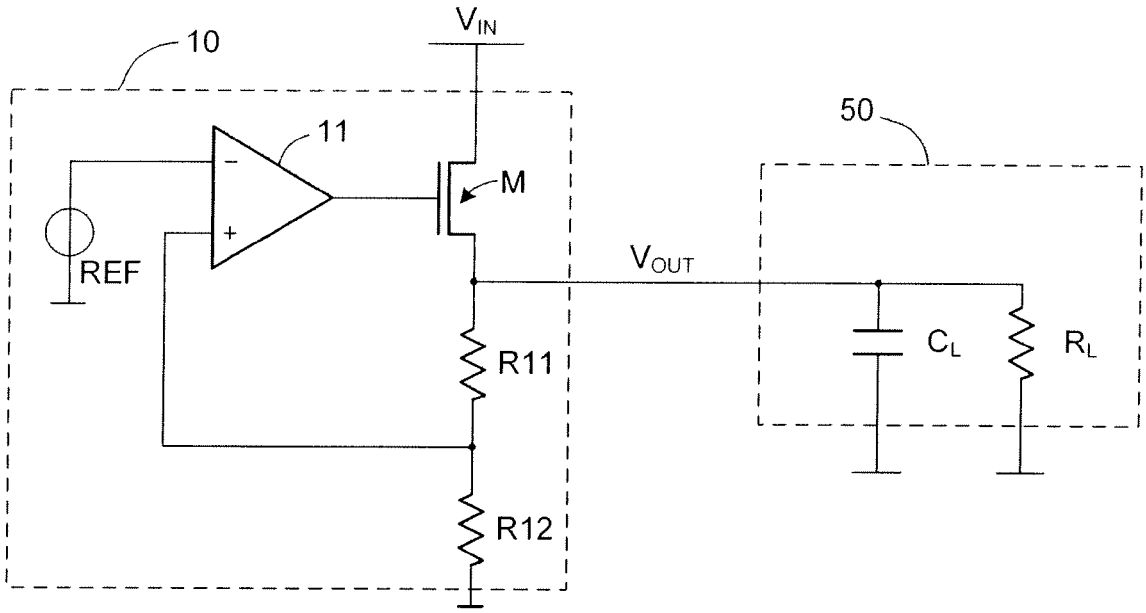
FIG. 4 (PRIOR ART)
FIG. 4 is a simplified schematic diagram showing a conventional LDO regulator.

FIG. 3 is a simplified schematic diagram showing a portable device 200 including an LDO regulator (negative feedback amplifier circuit) 210 according to a specific embodiment of the present invention. Portable device 200 is, for example, one of a cellular phone, a cordless phone, a pager, a personal digital assistant, a portable personal computer, a camcorder, and a digital camera, that includes a battery (power source) 205 and a load integrated circuit (IC) 250, which for simplicity is represented by a load resistor $R_L$ and a load capacitor $C_L$. LDO regulator 210 receives an unregulated input voltage $V_{IN}$ from battery 205 at its input terminal 211, and generates a regulated output signal $V_{OUT}$ at its output terminal 212 that is provided to load IC 250, thus facilitating the operation of portable device 200.

LDO regulator 210 includes a (first) current control element M1 that is preferably connected (but may be coupled) between input terminal 211 and output terminal 212, an error amplifier 213 for generating a control signal $V_{CNTL}$ that is applied to the control terminal of current control element M1 by way of boost zero compensating resistor $R_{BZ}$, and an output stabilization circuit 215. Current control element M1 is in one embodiment a PMOS field effect transistor, and in another embodiment an NMOS transistor, or a PNP or NPN bipolar transistor. Error amplifier 213 is an operational amplifier having an inverting input terminal coupled to a reference voltage source 214 and a non-inverting terminal coupled to a node Y, and provides a control voltage $V_{CNTL}$ according to known techniques. Output stabilization circuit 215 is connected in parallel with current control element M1 between input terminal 211 and output terminal 212, and provides a stabilization signal to node Y by way of a bypass capacitor (high pass filter) 218 having a capacitance $C_{BP}$. Feedback block 217 includes a voltage divider formed by resistors R11 and R12, and feeds back a portion of output voltage $V_{OUT}$ to node Y, where this portion is combined with the stabilization signal to produce a feedback voltage $V_{FB}$ that is applied to the non-inverting terminal of error amplifier 213.

In accordance with an embodiment of the present invention, output stabilization circuit 215 includes a (second) current control element M2, a "zero generating" (first) resistor $R_Z$, and bypass capacitor 218. Current control element M2 has a first terminal preferably connected (but may be coupled) to input terminal 211, a control terminal connected to the output terminal of error amplifier 213, and a second terminal connected to a node N. Resistor $R_Z$ (which may be implemented by one or more separate resistance elements) is connected between node N and output terminal 212. Bypass capacitor 218 has a first terminal connected to node N, and a second terminal connected to node Y.

In accordance with the present invention, output stabilization circuit 215 diverts part of the supplied load current $I_L$ through resistor $R_Z$ before adding it to the output load formed by load resistor $R_L$ and load capacitor $C_L$. The voltage developed across resistor $R_Z$ mimics the magnitude and phase of a zero in the Laplace transform of the transfer function of the open loop gain (i.e., a zero in the rational Laplace transform function representing the combined circuit formed by output stabilization circuit 215 and load IC 250). This mimicking signal is then passed through bypass capacitor, which provides a DC-block so that the DC value of the output voltage does not get imposed upon the signal Y, but only passes it's AC component. The partition of the total load current is conventionally determined by the ratio of the sizes (i.e., channel widths) of current control elements (e.g., PMOS transistors) M1 and M2. If n is defined as the ratio of these sizes as n equals M2/M1 (usually n<<1), then the value of the zero signal $V_Z$ has a time constant approximately equal to $C_L*nR_Z*RL/(nR_Z+R_L)$, which is in most practical cases close to $C_L*nR_Z$. The benefits of using output stabilization circuit 215 in this manner are to provide a stable output signal $V_{OUT}$ over a large load range, to avoid degradation of the ripple rejection at higher frequencies (which is a problem with conventional approaches). In addition, the zero generated by output stabilization circuit 215 is better controlled than in conventional approaches because it is less dependent on the uncontrollable parasitic resistor of the load capacitance $C_L$. Moreover, output stabilization circuit 215 can be fully integrated (i.e., fabricated on the same substrate as load IC 250 using the same process flow). The Boost compensating resistor $R_{BZ}$ serves to maintain the magnitude of the compensation voltage developed across $R_Z$ at higher frequencies where conventionally the compensating signal falls off and compensation is reduced. This helps prevent instabilities caused by other high frequency poles that can exist in amplifiers with high frequency operation.

In an exemplary practical embodiment, portable device 200 is a cell phone regulator using a battery that generates an unregulated input voltage $V_{IN}$ of approximately 4V (fully charged), and has an effective load resistor $R_L$ value of 30Ω and an effective load capacitance $C_L$ of 1 μF. In this case, current control elements M1 and M2 are PMOS transistors having sizes 50000/0.5 μm and 100/0.5 μm, respectively, zero resistor $R_Z$ has a resistance value of 80Ω, bypass capacitor $C_{BP}$ has a capacitance value of 30 pF. $V_{REF}$ is maintained at 1.25V using known techniques. The boost zero resistor has a typical resistance value of 100 Ohm but can be varied to position the boost zero to suit the application. Resistor values of 100 Ohm to 2000 Ohm are reasonable.

Although the present invention has been described with respect to certain specific embodiments, it will be clear to those skilled in the art that the inventive features of the present invention are applicable to other embodiments as well, all of which are intended to fall within the scope of the present invention. For example, although the present invention is specifically described with reference to an LDO regulator, the output stabilization circuit 215 may be used in any negative feedback control circuit having a significant capacitive load (i.e., the capacitive output load forms a dominant pole in the loop gain).

The invention claimed is:

1. A negative feedback amplifier system comprising:

a first current control element having a first terminal connected to a supply voltage, a control terminal, and a second terminal connected to an output terminal;

an output stabilization circuit including:

a second current control element having a first terminal connected to the voltage supply, a control terminal, and a second terminal, and a first resistor coupled between the second terminal of the second current control element and the output terminal;

an amplifier having at least one input terminal coupled to the second terminal of the second current control element, the amplifier also having an output terminal connected to the control terminals of the second current control element; and a boost zero compensating resistor connected between the output terminal of the amplifier and the input terminal of the first current control element.

2. The negative feedback amplifier system according to claim 1, wherein the boost zero compensating resistor has a resistance that is greater than 100 Ohm.

3. The negative feedback amplifier system according to claim 1, wherein each of the first and second current control elements comprises one of a P-type MOSFET transistor, an N-type MOSFET, a PNP-type bipolar transistor, and an NPN-type bipolar transistor.

4. The negative feedback amplifier system according to claim 3, wherein a ratio of a size of the second transistor to a size of the first transistor is smaller than one.

5. The negative feedback amplifier system according to claim 1, wherein the output stabilization circuit further comprises a high pass filter coupled between the second terminal of the second current control element and the input terminal of the amplifier.

6. The negative feedback amplifier system according to claim 5, further comprising a feedback block coupled between the second terminal of the second current control element and the input terminal of the amplifier.

7. The negative feedback amplifier system according to claim 6, further comprising a summing circuit having at least one input terminal coupled to the high pass filter, to the feedback block, and to and reference voltage source, and an output terminal connected to a first input terminal of the amplifier.

8. The negative feedback amplifier system according to claim 5, wherein the high pass filter comprises a bypass capacitor.

9. A low dropout voltage (LDO) regulator having an input terminal and an output terminal, the LDO regulator comprising:

a first current control element having a first terminal connected to the input terminal, a control terminal, and a second terminal connected to the output terminal;

an output stabilization circuit including:

a second current control element having a first terminal connected to the input terminal, a control terminal, and a second terminal, and a first resistor coupled between the second terminal of the second current control element and the output terminal; and an error amplifier having a first input terminal coupled to the output stabilization circuit, a second input terminal connected to a reference voltage source, and an output terminal connected to the control terminals of the second current control element; and a boost zero compensating resistor connected between the output terminal of the error amplifier and the input terminal of the first current control element.

10. The negative feedback amplifier system according to claim 9, wherein the boost zero compensating resistor has a resistance that is greater than 100 Ohm.

11. The LDO regulator according to claim 9, wherein each of the first and second current control elements comprises one of a P-type MOSFET transistor, an N-type MOSFET, a PNP-type bipolar transistor, and an NPN-type bipolar transistor.

12. The LDO regulator according to claim 11, wherein a ratio of a size of the second transistor to a size of the first transistor is smaller than one.

13. The LDO regulator according to claim 9, wherein the output stabilization circuit further comprises a feedback capacitor having a first terminal connected to the second terminal of the second current control element, and a second terminal connected to the first input terminal of the error amplifier.

14. The LDO regulator according to claim 9, wherein the error amplifier comprises an operational amplifier, wherein the first input terminal comprises an non-inverting input terminal of the operational amplifier, and wherein the second input terminal comprises a inverting input terminal of the operational amplifier.

15. A portable device comprising:

a power source for generating an input signal;

a load circuit; and a voltage regulator having an input terminal connected to the power source and an output terminal connected to the load circuit, wherein the voltage regulator comprises:

a first current control element having a first terminal connected to the input terminal, a control terminal, and a second terminal connected to the output terminal;

an output stabilization circuit including:

a second current control element having a first terminal connected to the input terminal, a control terminal, and a second terminal, and a first resistor coupled between the second terminal of the second current control element and the output terminal;

an error amplifier having a first input terminal coupled to the output stabilization circuit, a second input terminal connected to a reference voltage source, and an output terminal connected to the control terminals of the second current control element; and a boost zero compensating resistor connected between the output terminal of the error amplifier and the input terminal of the first current control element.

16. The portable device according to claim 15, wherein the boost zero compensating resistor has a resistance that is greater than 100 Ohm.

17. The portable device according to claim 15, wherein each of the first and second current control elements comprises one of a P-type MOSFET transistor, an N-type MOSFET, a PNP-type bipolar transistor, and an NPN-type bipolar transistor.

18. The portable device according to claim 17, wherein a ratio of a size of the second transistor to a size of the first transistor is smaller than one.

19. The portable device according to claim 15, wherein the output stabilization circuit further comprises a feedback capacitor having a first terminal connected to the second terminal of the second current control element, and a second terminal coupled to the first input terminal of the error amplifier.

20. The portable device according to claim 19, further comprising a feedback block including a first resistor connected in series with a second resistor between the output terminal and a fixed voltage source, wherein a node located between the first and second resistors is connected to the first input terminal of the error amplifier.

21. The portable device according to claim 15, wherein the error amplifier comprises an operational amplifier, wherein the first input terminal comprises an non-inverting input terminal of the operational amplifier, and wherein the second input terminal comprises a inverting input terminal of the operational amplifier.

22. The portable device according to claim 15, wherein the portable device comprises one of a cellular phone, a cordless phone, a pager, a personal digital assistant, a portable personal computer, a camcorder, and a digital camera.

23. The portable device according to claim 15, wherein the load circuit and the voltage regulator are integrally fabricated on a single semiconductor substrate.

* * * * *

UNITED STATES PATENT AND TRADEMARK OFFICE

CERTIFICATE OF CORRECTION

PATENT NO. : 7,656,139 B2
APPLICATION NO. : 11/764758
DATED : February 2, 2010
INVENTOR(S) : van Ettinger et al.

It is certified that error appears in the above-identified patent and that said Letters Patent is hereby corrected as shown below:

On Title page delete Item (75) and insert Item (75)

-- (75) Inventors: Roel van Ettinger, Bathgate (GB); Christian Gater, Dunblane (SCOT); Paul Wilson, Linlithgow, West Lothian (GB) --

Signed and Sealed this

Ninth Day of November, 2010

David J. Kappos

David J. Kappos
*Director of the United States Patent and Trademark Office*